US005208508A

United States Patent [19]

Shaw

[11] Patent Number: 5,208,508

[45] Date of Patent: May 4, 1993

[54] CATHODE HEATER POTTING ASSEMBLY

[75] Inventor: Beverley A. Shaw, North Reading, Mass.

[73] Assignee: Raytheon Company, Lexington, Mass.

[21] Appl. No.: 760,296

[22] Filed: Sep. 16, 1991

[51] Int. Cl.[5] ..... H01J 19/18

[52] U.S. Cl. ..... 313/446; 313/346 R

[58] Field of Search ..... 313/446, 346 R, 337, 313/340

[56] References Cited

U.S. PATENT DOCUMENTS

| | | | |
|---|---|---|---|
| 4,427,916 | 1/1984 | Shroff | 313/346 R |
| 4,893,052 | 1/1990 | Tanabe et al. | 313/346 R |
| 4,904,897 | 2/1990 | Van Esdonk et al. | 313/346 R |

FOREIGN PATENT DOCUMENTS

| | | | |
|---|---|---|---|
| 141138 | 11/1981 | Japan | 313/446 |

*Primary Examiner*—Sandra L. O'Shea

*Attorney, Agent, or Firm*—Denis G. Maloney; Richard M. Sharkansky

[57] ABSTRACT

A potted heater assembly and a method of forming such a potted heater assembly comprises the steps of introducing into a mold having a filament disposed therein a slurry containing a liquid vehicle and particles of a refractory ceramic, said particles having a cylindrical shape and a diameter of generally less than a micron. The method further includes the step of removing the liquid vehicle from the slurry to leave behind a consolidated ceramic embedding the filament, and heating the ceramic having the embedded filament to further consolidate the ceramic to provide said ceramic having a density of at least 85% of theoretical density for the particular ceramic. The potted heating assembly having a ceramic potting embedding a filament heater is provided having higher post-sinter density than prior assemblies and has substantially higher strength.

7 Claims, 3 Drawing Sheets

30
37a
38a
36a
35a
3A
3A
33a
32a
34
39
35b
33b
32b
35a
34a'''
34a''
34a'

CATHODE HEATER POTTING ASSEMBLY

BACKGROUND OF THE INVENTION

This invention relates generally to electronic devices that use thermionic emission of electrons and, more particularly, to heater assemblies for heating cathodes to produce the thermionic emitted electrons.

As is known in the art, vacuum devices such as travelling wave tubes generally include a cathode which is heated to produce thermionically emitted electrons. Generally, the cathode is indirectly heated by use of a heater assembly which houses a filament. The filament is supplied a current to raise the temperature of the filament to a temperature in the range of at least 900° C. to 1200° C. The filament in the heater assembly provides the thermal energy required to raise the temperature of the cathode electrode to provide sufficient electron emission from the cathode to power the tube.

The heater assembly generally includes a filament wire which is coiled and is maintained in a position relative to the cathode throughout the operating life of the microwave tube. One approach to providing such heater assemblies is to provide a coiled filament wire supported by a dielectric potting. Generally, the dielectric used for the potting must be a relatively refractory material such as a ceramic in order to withstand the relatively high temperatures typically provided by the filament electrode. Since thermal transfer properties between the heater filament and the cathode are a critical characteristic to determine overall thermionic emission of electrons, the physical arrangement of the heater and the cathode must remain substantially constant over the operating life of the tube. Any variation in the position of the heater filament with respect to the cathode will cause a concomitant change in the temperature in the emitting surface of the cathode and thus a change in the rate of electron emission from the surface.

Electron emission from such a surface is very sensitive to temperature variations. Further, the cathode heater assemblies are subject to rapid changes in temperature which can cause failure of the assembly by cracking of the potting material. Moreover, in many applications of these tubes, such as in airborne applications the tubes are subjected to high levels of mechanical vibration and mechanical shock which likewise can have adverse affects on the potting material and can cause failure of the heater.

In order to provide a suitable potting for tubes presently used, the approach generally used is to provide a machined sleeve of a refractory type of metal to which is attached or formed a "cathode button" or the cathode electrode from which thermionically emitted electrons are provided. The sleeve and button in combination provide a mold into which an aqueous slurry of a refractory oxide such as aluminum oxide powder is introduced to encapsulate a coiled filament wire which is disposed in the mold. The aluminum oxide powder or other refractory oxide powders used in the slurry are characterized as having relatively irregular, random shapes and large particle sizes. The slurry is introduced to the mold provided by the sleeve and cathode button. At this juncture, the slurry has a green or prefire density of about 40% of theoretical density (T.D.). The slurry in the mold is fired to sinter the aluminum oxide or other refractory oxide into a solid mass. With such a low green state density, a large degree of shrinkage occurs during the sintering process as there is a concomitant reduction in the volume of the slurry material as water is released from the slurry material and the aluminum oxide coalesces into a consolidated or more densified mass. The reduction in volume which accompanies the step of densifying the mass requires the addition of more slurry to the mold and repeating the high temperature firing or sintering until the potting is built up to its final height. That is, the approach requires additional reworking of the potting until the final height of the potting is provided. Generally, sintered potted assemblies do not attain a final density of more than 80% of T.D. Often the density is in the range of 70% to 75% of T.D.

Several problems are present with this approach. The first problem is a consideration of cost. Since multiple slurry addition and firing cycles are generally required to provide a suitable potting for the heater, the additional cycles increase the cost of processing of the potted assembly. Further, due to the relatively large shrinkage or decrease in volume of the potting between its "green" or prefired stage and the potting after having been fired or sintered, defects in the material of the potting often occur. Such defects can include cracks and voids. Often these cracks and voids occur in areas of the potting which are not visible or accessible and thus cannot be reworked. These latter problems contribute to relatively low yields for these structures, as well as, a potting having relatively low mechanical strength, relatively low density, and less than ideal thermal transfer characteristics.

SUMMARY OF THE INVENTION

In accordance with the present invention, a method of forming a potted heater assembly comprises the steps of introducing into a mold having a filament disposed therein a slurry containing a liquid vehicle and particles of a refractory ceramic, said particles having a cylindrical shape and a diameter of generally less than a micron. The method further includes the step of removing the liquid vehicle from the slurry to leave behind a consolidated ceramic embedding the filament, and heating the ceramic having the embedded filament to further consolidate the ceramic to provide said ceramic having a density of at least 85% of theoretical density for the particular ceramic. With this particular arrangement, a potted heating assembly having a ceramic potting embedding a filament heater is provided. Since the spherical particles of refractory oxide are introduced into a mold to form the heater assembly, the spherical particles will have maximal surface area and will be arranged in a close packing arrangement, such that in a prefired stage or "green state" of the ceramic, the ceramic will have a substantially higher density than prior approaches. Thus, there will be substantially less shrinkage of the ceramic after firing of the ceramic and, moreover, the ceramic can be fired to substantially higher densities over shorter periods of time than the prior approaches. This arrangement also, in general, eliminates additional reworking of the assembly as generally required in the prior art. Since there is less shrinkage with this approach, there is also a concomitant reduction in cracks and voids in the ceramic.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
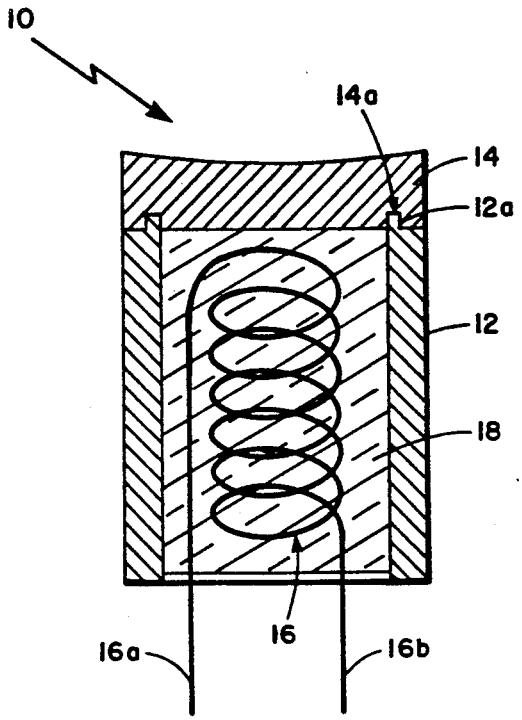
FIG. 1 is a cross-sectional view of a typical potted heating assembly in accordance with the present invention.

Referring now to FIG. 1, a potted cathode heater 10 is shown to include a sleeve 12, here comprised of a refractory type of metal, such as molybdenum or other suitable refractory metals, with said sleeve 12 generally being cylindrical in shape. At one end of sleeve 12 is machined an outer peripheral slot 12*a* which extends around the circumferential end of sleeve 14. A "cathode button" 12 is disposed over and brazed to the slotted edge of sleeve 12. Cathode button 14 has a corresponding groove 14*a* which is used to receive the slot 12*a* from sleeve 12. Cathode button 14 is typically comprised of tungsten often doped with material to lower the work function of the metal (i.e. to increase electron emission). Typical dopants include barium, calcium, and aluminum, and combinations thereof. The sleeve 12 contains a dielectric 18 here of a refractory type of ceramic such as an oxide or a nitride and, more particularly, of an oxide such as an aluminum oxide or a nitride such as aluminum nitride. Dielectric 18 has embedded therein a filament 16 which is here a coiled wire comprised of tungsten or other suitable refractory type of metal having a suitable resistivity and including materials such as tantalum, rhenium, and so forth, having a pair of ends 16*a*, 16*b* adapted to be connected to a power source to feed a current through said wire and heat said wire and thus the cathode button 14 as would be generally known by a person of skill in the art. Here the cathode potted heater assembly 10 has the dielectric potting 18 which is substantially free of defects such as cracks, voids, and pores and is generally characterized as comprised of a refractory dielectric material which has an actual density generally in the range of 85%–95% and up to 100% of the theoretical density of the particular material used.

Figure 2:
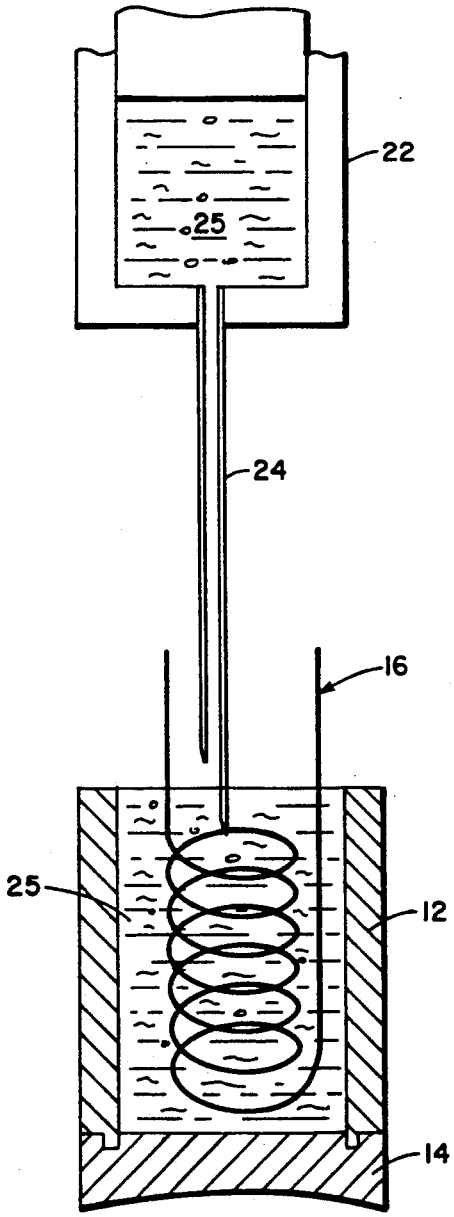
FIG. 2 is a diagrammatical view useful for explaining one technique for providing the potted heating assembly in accordance with the present invention.

Referring now to FIG. 2, apparatus which may be used to practice one aspect of the invention is shown. The apparatus includes the conductive sleeve 12 and coupled cathode button 14 having the filament wire 16 disposed therein. A syringe 22 of the hypodermic type charged with a slurry 25 of refractory ceramic, as will be further described below, is disposed to introduce said slurry through needle 24 into the interior of sleeve 12. After, introduction of the slurry 25, the sleeve, and cathode button containing the slurry is raised to an elevated temperature in the range of 200° C. to 400° C. and typically about 250° C. for a period of time sufficient to drive off the liquid vehicle of the slurry and to coalesce and thus density the refractory ceramic particles to provide the body having a "green state" density of about 70% of theoretical density (T.D.). Alternatively, the slurry can be mixed with a bonder or plasticizer material such that the mixture has a suitable prefired or presintered green state density so that it can be directly fired or sintered to final density.

Here the slurry is an aqueous slurry, that is, a slurry comprised of water and particles of the refractory oxide. The particles are spherical particles of aluminum oxide or other desired refractory ceramic. In general, any refractory type of dielectric, in particular oxide type, can be used provided that submicron starting powder of spherical particles of the dielectric is provided. Another example of a suitable powder is aluminum nitride. Here aluminum oxide is used. Further, the spherical shaped particles generally have a submicron diameter. The diameter of the aluminum oxide particles is generally less than 1 micron and preferably in the range of 0.1 μm to 1.0 μm. Commercially available sources of aluminum oxide spherical submicron particles maybe obtained from several suppliers. One such supplier is CPS (Ceramic Process Systems), 155 Fortune Blvd., Milford, MA 01757. The slurry 25 is provided by using the minimal amount of water necessary to delivery the particles to the mold formed by the sleeve 12 and cathode button 14. If more water is used, then the volume occupied by the dielectric after firing would be less, requiring "topping off" with additional slurry. However, since the particles are uniform (i.e. spherical), the occurrences of cracking and voids as common with the prior art approaches will be nil or non-existent. The optimum amount of water would be related somewhat to the destruction of particle size in the powder, as well as, the maximum and minimum particle sizes used.

After introduction and consolidation of the slurry to a "green state" density, the sleeve 12 and cathode button 14 carrying the green state dielectric are placed in a furnace disposed at an elevated temperature preferably in the range of 1,200° C. to 1,400° C. for $Al_2O_3$ to drive off remaining portions of the aqueous solution and to solidify and coalesce the aluminum oxide particles into a densified aluminum oxide ceramic which generally has a density of at least 85% and generally in the range of 95% to 98% of theoretical density.

By using the aluminum oxide spherical particles, a green state or prefired density which is substantially higher than the green state or prefired density of the prior art approaches is obtained. Typical green state density for the insulator as provided from this slurry are about 70% whereas for the prior approach such densities are typically 40% of theoretical density. This slurry having the submicron spherical particles provides overall significant reduction in the amount of shrinkage after drying and postfiring of the ceramic material. Thus, there are less reworking steps required and, more important, there is less opportunity for small pores or voids to be present in the material after firing, as well as, cracking of the material as is a common occurrence with the prior art techniques.

Figures 3, 3A:
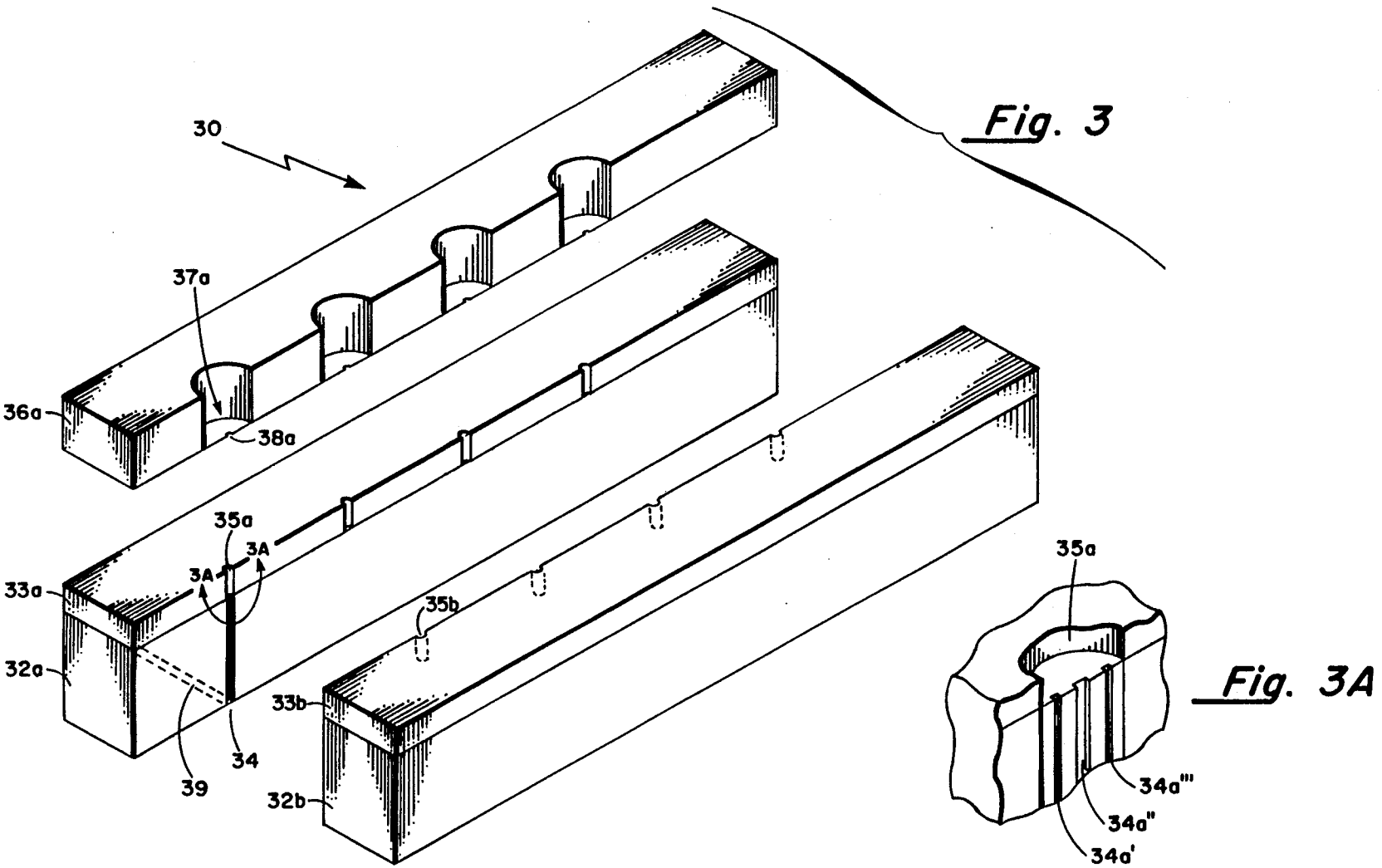
FIGS. 3 and 4 are exploded isometric views useful for understanding an alternate technique for providing the potted heating assembly in accordance with the present invention.
FIG. 3A and 4A are blown-up views taken along lines 3A—3A of FIG. 3 and 4A—4A of FIG. 4, respectively.
Figure 4A:
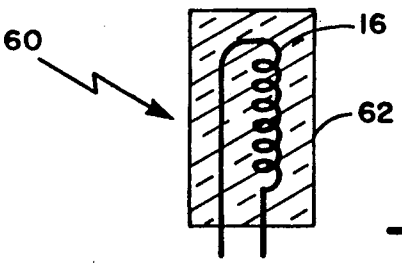
Figure 4:
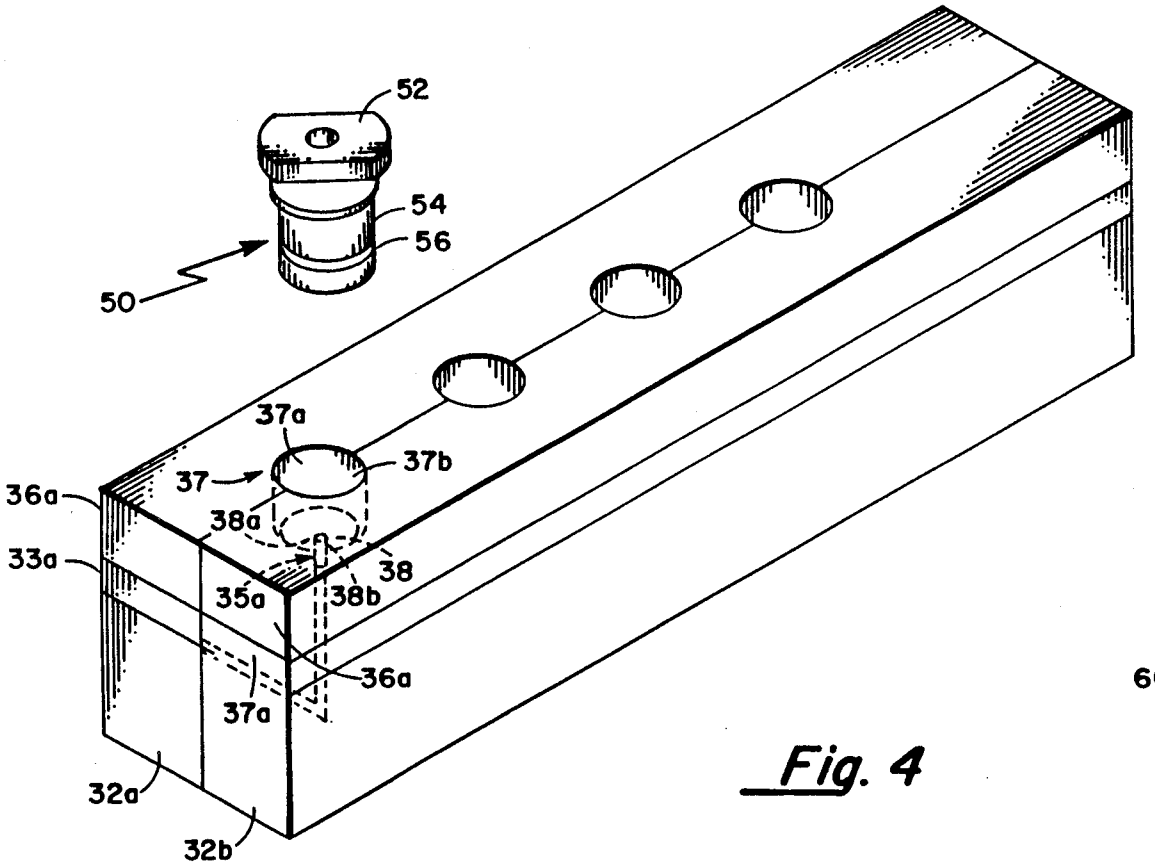

Referring now to FIGS. 3, 3A, 4 and 4A a preferred molding apparatus for providing the potted cathode heater assemblies is shown to include here a pair of base members 32*a*, 32*b*. Each one of said base members supporting an upper plate 33*a*, 33*b*, respectively with said plate having a plurality of hemi-cylindrical shaped bores 35*a*, 35*b* disposed therethrough as shown. The bases 32*a*, 32*b* are mated together via screws (not shown) to provide a plurality of cylindrical bores 35 in the composite arrangement, as shown in FIG. 4. As shown in FIGS. 3 and 3A, one of said bases, here base 32*a*, has a channel region 34 disposed along the inner major surface of the block 32*a*. Here the channel region 34 has a first terminus at an upper end of block 32*a* disposed adjacent a bottom portion of a corresponding one of the hemi-cylindrical bores 35*a* with said channel having three machined groove regions 34*a*', 34*a*'', and 34*a*'''. Regions 34*a*, and 34*a*''' are disposed to allow placement of wire leads for the filaments, whereas region 34*a*'' is slightly larger and deeper and provides a channel for allowing drainage of water from the slurry to be introduced into the bores 35 (FIG. 4) as will be discussed. Disposed over each one of the plates 33*a* and 33*b* are caps 36*a*, as well as, a second cap 36*b* (FIG. 4 not shown in FIG. 3). Each one of said caps 36*a* and 36*b* have a second plurality of a hemi-cylindrical bores 37*a*, 37*b* disposed through the caps 36*a*, 36*b*. At a bottom portion of caps 36*a*, 36*b* and the terminus of the bores 37*a*, 37*b* is disposed a small semicircular aperture 38*a*, 38*b* (FIG. 4) which permits a slurry introduced into each one of the plurality of bores 37 (FIG. 4) to be fed into the underlying one of the plurality of bores 35 (FIG. 4.) as will be described. Along a bottom surface of the base 32 is provided a second channel 39 which is coupled to channels 34*a*'' and which permits the liquid vehicle of the slurry to be siphoned or otherwise removed from the molding apparatus 30.

Referring in particular now to FIG. 4, a preferred apparatus and technique for providing the potted heating assemblies will now be described. In particular referring to FIG. 4, a plunger member 50 which has a plate portion 52 suitable for providing pressure such as finger pressure or other suitable means such as an automated application of pressure has disposed over a bottom surface thereof a substantially cylindrical-shaped stub portion 54 having a groove (not numbered) within which is disposed an 0-ring washer 56. The plunger is dimensioned to fit substantially uniformly within the bores 37 and the 0-ring is disposed to provide a substantially tight seal to prevent slurry from oozing or squirting past the plunger while the plunger is forced into one of the bores 37 by application of force thereto. Under such pressure, when the slurry mentioned above is introduced into each one of the bores 37 and the plunger is then forced into one of the bores 37 a portion of the slurry will be forced through the hole 38 at the bottom of the bore 37 and thus fill the underlying aligned bore 35 within which is disposed the coiled filament wire (not shown). The channel region 34 disposed under the portions 35*a* of the bores 35 provide regions for disposing ends of the filament wires of the heater filament, as well as, a channel 34*a*'' to permit surplus slurry and, in particular the liquid vehicle or here aqueous vehicle of the slurry to leak out of the bore 35.

This slurry is then dried using a low temperature bake such as 200° C. to 400° C. preferably 250° C. which provides a prefired "green state" potted filament having the filament wire embedded in a here cylindrical-shaped dielectric with the dielectric having a typical prefired green state density of 70% T.D. Such a filament can then be fired at a temperature in the range of 1,200° C.-1,400° C. to further densify the ceramic and provide the ceramic having a density of 85% and generally up to about 95%-98% of theoretical density to provide the densified potted heater 60 (FIG. 4A) having filament 16 embedded in densified ceramic 62. By firing over higher temperatures and over longer periods of time, densities approaching 100% can be obtained. However, for the purposes of this invention, this is generally not necessary.

The potted heater 60 after firing may then be coated with a wet solution of the slurry here aluminum oxide and disposed within a sleeve 12 having a cathode button 14 as generally described in FIG. 1. The arrangement is fired for a second cycle to coalesce the aluminum oxide and to wet the sleeve, 12 and cathode button 14 with the slurry and thus attach the potted heater to the sleeve 12 and cathode button 14 and provide the potted heating assembly 10, as generally shown in conjunction with FIG. 1.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A potted heater assembly comprising:
   a member of a dielectric material formed from a starting powder of spherical shaped particles of said dielectric material having a diameter in the range of 0.1 μm to 1.0 μm; and
   a coiled filament embedded in the dielectric material of the member.

2. The potted heater assembly, of claim 1, wherein said dielectric material is selected from the group consisting of refractory oxides and refractory nitrides.

3. The potted heater assembly, of claim 1, wherein said dielectric is aluminum oxide.

4. A potted heater assembly comprising:
   a member of a dielectric material formed from a starting powder of spherical shaped particles of said dielectric material having a diameter in the range of 0.1 μm to 1.0 μm;
   a coiled filament embedded in said dielectric material;
   a sleeve comprised of a refractory metal disposed around a first surface of the dielectric; and
   a cathode button coupled to said sleeve and disposed over a second surface of said dielectric material.

5. The potted heater assembly, of claim 4, wherein said sleeve is comprised of molybdenum and said cathode button is comprised of tungsten doped with barium, calcium, and aluminum.

6. The potted heater assembly, of claim 4, wherein said dielectric material is selected from the group consisting of refractory oxides and refractory nitrides.

7. The potted heater assembly, of claim 4, wherein said dielectric is aluminum oxide.

* * * * *